US006158403A

United States Patent [19]

Berecewicz et al.

[11] Patent Number: 6,158,403

[45] Date of Patent: Dec. 12, 2000

[54] SERVO CONTROL SYSTEM FOR AN ELECTROMAGNETIC VALVE ACTUATOR USED IN AN INTERNAL COMBUSTION ENGINE

[75] Inventors: Patrick Berecewicz, La Mirada; Michael Guidry, Redondo Beach; Leo E. Schneider, Cypress; John Sharples, Redondo Beach, all of Calif.

[73] Assignee: Aura Systems, Inc., El Segundo, Calif.

[21] Appl. No.: 09/281,581

[22] Filed: Mar. 30, 1999

[51] Int. Cl.[7] ..... F01L 9/04

[52] U.S. Cl. ..... 123/90.11

[58] Field of Search ..... 123/90.11; 251/129.01, 251/129.05, 129.1, 129.15, 129.16

[56] References Cited

U.S. PATENT DOCUMENTS

| | | | |
|---|---|---|---|
| 4,706,619 | 11/1987 | Buchl | 123/90.11 |
| 4,957,074 | 9/1990 | Weissler, II et al. | 123/90.11 |
| 5,752,478 | 5/1998 | Sono et al. | 123/90.11 |
| 5,964,192 | 10/1999 | Ishii | 123/90.11 |
| 5,983,847 | 11/1999 | Miyoshi et al. | 123/90.11 |
| 5,988,123 | 11/1999 | Miyoshi et al. | 123/90.11 |

*Primary Examiner*—Weilun Lo

*Attorney, Agent, or Firm*—Blakely, Sokoloff, Taylor & Zafman LLP

[57] ABSTRACT

A control system for an internal combustion engine having a plurality of cylinders and an engine control module is disclosed. Each cylinder has at least one intake valve and one exhaust valve. Each valve is actuated by an electromagnetic valve actuator. The servo control system includes a control module and a power module. The control module includes an electronic control unit coupled to the engine control module for receiving engine sensor information, a servo board coupled to the electronic control unit for receiving a command signal and sending delay feedback signals to the electronic control unit, and a demodulation board coupled to the servo board for sending a voltage signal proportional to the valve position to the servo board. The power module is coupled to the electromagnetic valve actuator and the control module and provides current output to the electromagnetic valve actuator and sends a current monitor signal proportional to the current output back to the control module of the control system.

16 Claims, 8 Drawing Sheets

ECU

MAP = Manifold Absolute Pressure
T/P = Throttle Position
MAF = Mass Air Flow
EGO = Exhaust Gas Oxygen
ACT = Air Charge Temperature
CTS = Coolant Temperature
PIP = Position Information Pulse
FLT = Fault Signal
DE1 = Delay Time Trip Signal, Exhaust #1
E1 = Exhaust #1 Valve Command
DI1 = Delay Time Trip Signal, Intake #1
I1 = Intake #1 Valve Command

SERVO BOARD

SNS = Sense Signal
ECU = ECU Valve Command
VSI = Valve Shutdown Interrupt
LSI = Load Sample Interrupt
DLY = Delay Time Trip Signa
LOD = Engine Load Signal
A/S = Anti-Servo Signal
IOP = Open Current Command
ICL = Close Current Command
INH = Current Amp Inhibit Signal
FLT = Fault Signal

DEMOD

E1C = Exhaust #1 Close Negative
E1C+ = Exhaust #1 Close Positive
E10– = Exhaust #1 Open Negative
E10+ = Exhaust #1 Open Positive
I1C– = Intake #1 Close Negative
I1C+ = Intake #1 Close Positive
I10– = Intake #1 Open Negative
I10+ = Intake #1 Open Positive
SE1 = Sense Signal, Exhaust #1
SI1 = Sense Signal, Intake #1
SYNC = Sync Signal

DAQ PORT

1 = Intake #1 ECU Valve Command
2 = Exhaust #1 ECU Valve Command
3 = Position Signal, Intake #1
4 = Position Signal, Exhaust #1
5 = Current Command, Exh. #1 Close
6 = Current Command, Exh. #1 Open
7 = Current Command, Int. #1 Close
8 = Current Command, Int. #1 Open
9 = Current Monitor, Exh. #1 Close
10 = Current Monitor, Exh. #1 Open
11 = Current Monitor, Int. #1 Close
12 = Current Monitor, Int. #1 Open

FIG. 3A

CURRENT AMPLIFIER

IOP1 = Open Current Command #1
ICL1 = Close Current Command #1
MOP1 = Open Current Monitor #1
MCL1 = Close Current Monitor #1
INH1 = Current AMP Inhibit Signal #1
IOP2 = Open Current Command #2
ICL2 = Close Current Command #2
MOP2 = Open Current Monitor #2
MCL2 = Close Current Monitor #2
INH2 = Current Amp Inhibit Signal #2
HVOLT = High Voltage Input
PGND = Power Ground Input DOP1+ = Open Drive Current #1 Positive
DOP1− = Open Drive Current #1 Negative
DCL1+ = Close Drive Current #1 Positive
DCL1− = Close Drive Current #1 Negative
DOP2+ = Open Drive Current #2 Positive
DOP2− = Open Drive Current #2 Negative
DCL2+ = Close Drive Current #2 Positive
DCL2− = Close Drive Current #2 Negative
RESET = Current Amp Reset Signal
SYNC = Sync Signal
FLT = Fault Signal

REGULATOR

F12 = Alternator Field Control, 12 Volt
P12 = Alternator Power Input, 12 Volt
GND = Ground
F100 = Alternator Field Control, 100 Volt
P100 = Alternator Power Input, 100 Volt
HVPR = High Voltage Power Rail
PGND = Power Ground

FIG. 5A

SERVO CONTROL SYSTEM FOR AN ELECTROMAGNETIC VALVE ACTUATOR USED IN AN INTERNAL COMBUSTION ENGINE

FIELD OF THE INVENTION

The present invention relates generally to a servo control system for an internal combustion engine using electromagnetic valve actuators in connection with each engine cylinder, and more particularly to a servo control system for an internal combustion engine using electromagnetic valve actuators in connection with each engine cylinder that utilizes valve position information to control operation of the valve.

BACKGROUND OF THE INVENTION

In an ordinary engine valves are controlled to open and close so that a cylinder may perform an induction and exhaust operation. It is known to use an electromagnetically actuated valve in connection with each cylinder in an internal combustion engine. One such type of electromagnetically actuated valve includes an armature, a pair of electromagnets disposed in opposed relation to each other on opposite sides of the armature so as to be able to apply an electromagnetic attracting force to the armature, and a pair of return springs for biasing the armature toward a neutral position centrally located between the electromagnets.

The electromagnetically actuated valve system of the present invention functions as a replacement for conventional cam driven engine valvetrain systems by substituting electromagnetic actuators and control and power electronics in place of the engine's camshaft, timing gears, timing belt, rocker arm assemblies, and other valvetrain related components. This substitution results in an engine valve actuation system that is fully independent of the crankshaft, thus allowing unrestricted investigation and implementation of various variable valve timing strategies. The benefits of implementing variable valve timing techniques to an internal combustion engine are numerous.

The servo control system of the present invention uses a position-based algorithm to control valve operation. Therefore, the control system looks at the position of the valve armature and determines several factors. First, the system determines whether the valve landing velocity was adequate. Second, the system monitors the position of the armature after it lands. The controller then provides corrections to the power input either for the next cycle, or if a fallout occurs power input is adjusted immediately. Moreover, a feed-forward algorithm allows the control system to predict and provide additional power to correct for sudden changes in engine load. Finally, a self learning algorithm optimizes the feed forward map to minimize the landing velocity and the power consumption under changing load conditions.

SUMMARY OF THE INVENTION

Accordingly, it is a primary object of the present invention to overcome one or more disadvantages and limitations of the prior art.

Another object of the present invention is to provide a servo control system that controls transition of an electromagnetically actuated valve based on the position of the valve.

Still another object of the present invention is to provide a servo control system for an electromagnetically actuated valve that operates at minimal power.

According to a broad aspect of the present invention, a control system for an internal combustion engine having a plurality of cylinders and an engine control module. Each cylinder has at least one intake valve and one exhaust valve. Each valve is electromagnetically actuated via an armature. The servo control system includes a control module and a power module. The control module includes an electronic control unit coupled to the engine control module for receiving engine sensor information, a servo board coupled to the electronic control unit for receiving a command signal and sending delay feedback signals to the electronic control unit, and a demodulation board coupled to the servo board for sending a voltage signal proportional to the valve position to the servo board. The power module is coupled to the electromagnetically actuated valve and the control module and provides current output to the electromagnetically actuated valve.

These and other objects, advantages and features of the present invention will become readily apparent to those skilled in the art from a study of the following description of an exemplary preferred embodiment when read in conjunction with the attached drawing and appended claims.

DESCRIPTION OF AN EXEMPLARY PREFERRED EMBODIMENT

Figure 1:
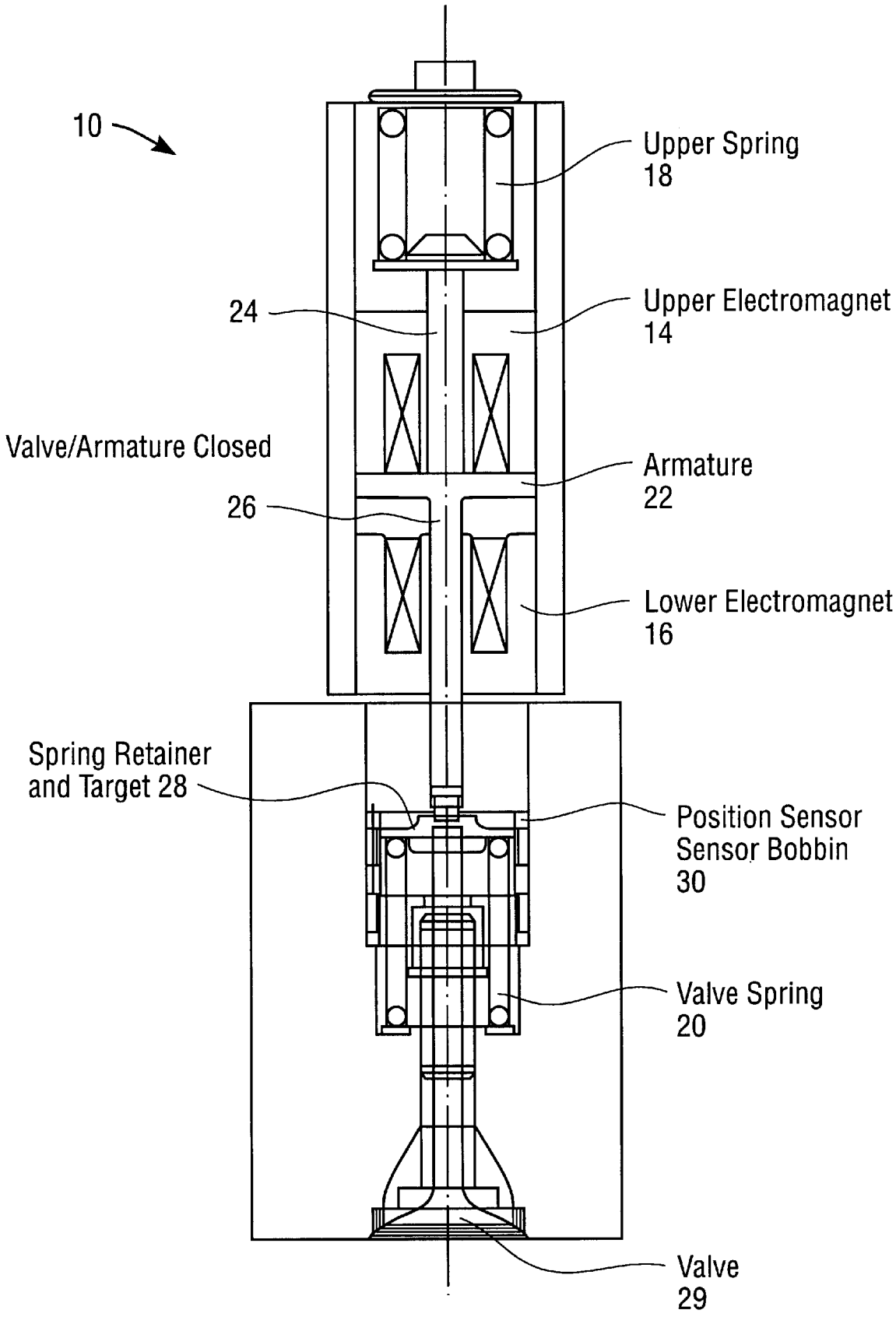
FIG. 1 is a front cross-sectional view of the electromagnetically actuated valve used in the servo control system of the present invention.

The invention will now be described in detail with reference to the drawings showing embodiments thereof. Referring first to FIG. 1, there is shown an electromagnetic valve actuator 10 used in the electromagnetically actuated valve servo control system 12 (shown in FIG. 2) according to an embodiment of the invention. The actuator 10 is comprised of an upper or close electromagnet 14 and a lower or open electromagnet 16 opposed to each other in the longitudinal direction. An upper or open spring 18 is disposed above the upper electromagnet 14 and a lower or close spring 20 is disposed below the lower electromagnet 16. An armature 22 is connected to a valve shaft 24 and disposed intermediate the upper and lower electromagnets 14,16. The shaft 26 transfers moving forces to the valve 29.

The electromagnetic valve actuator 10 of the present invention operates on the principle of energy storage, conversion and transfer. The two opposing springs 18,20 apply opposite forces on a moveable mass 26. The moveable mass 26 includes the armature 22, springs 18,20, valve shaft 24 and a retainer 28. The actuator 10 is in static equilibrium at the neutral position where the spring forces are equally counter-balanced. When the actuator 10 is initialized to the closed position just prior to engine start, potential energy is stored in the compressed actuator open spring 18. When the servo control system 12 commands the valve to transition to the open position, the close electromagnet 14 is de-energized allowing the potential energy stored in the open spring 18 to be converted into kinetic energy through the acceleration of the moving mass up to approximately the neutral position. Once this position is reached, the moving mass starts to decelerate as it compresses the valve close spring 22, transferring the kinetic energy back into potential energy.

The servo control system of the present invention compensates for friction and other damping losses by energizing the open electromagnet 16 at the proper position in the valve's transition, referred to as a trip point, to add a precise amount of kinetic energy slightly greater than the energy lost. This process ensures that the armature and moving mass compress the valve close spring 20 fully and reach the open electromagnet 16. When the servo control system commands the valve to transition to the close position this series of events is repeated in the opposite direction.

The electromagnetically actuated valve of the present invention preferable includes a valve position sensor 30. In the embodiment of the invention shown in FIG. 1, the position sensor 30 detects the position of the valve spring retainer 28. In another embodiment of the invention the position sensor detects the position of the armature 22. Alternatively the position sensor may detect the position of other moving target areas of the valve or armature.

Figure 2:
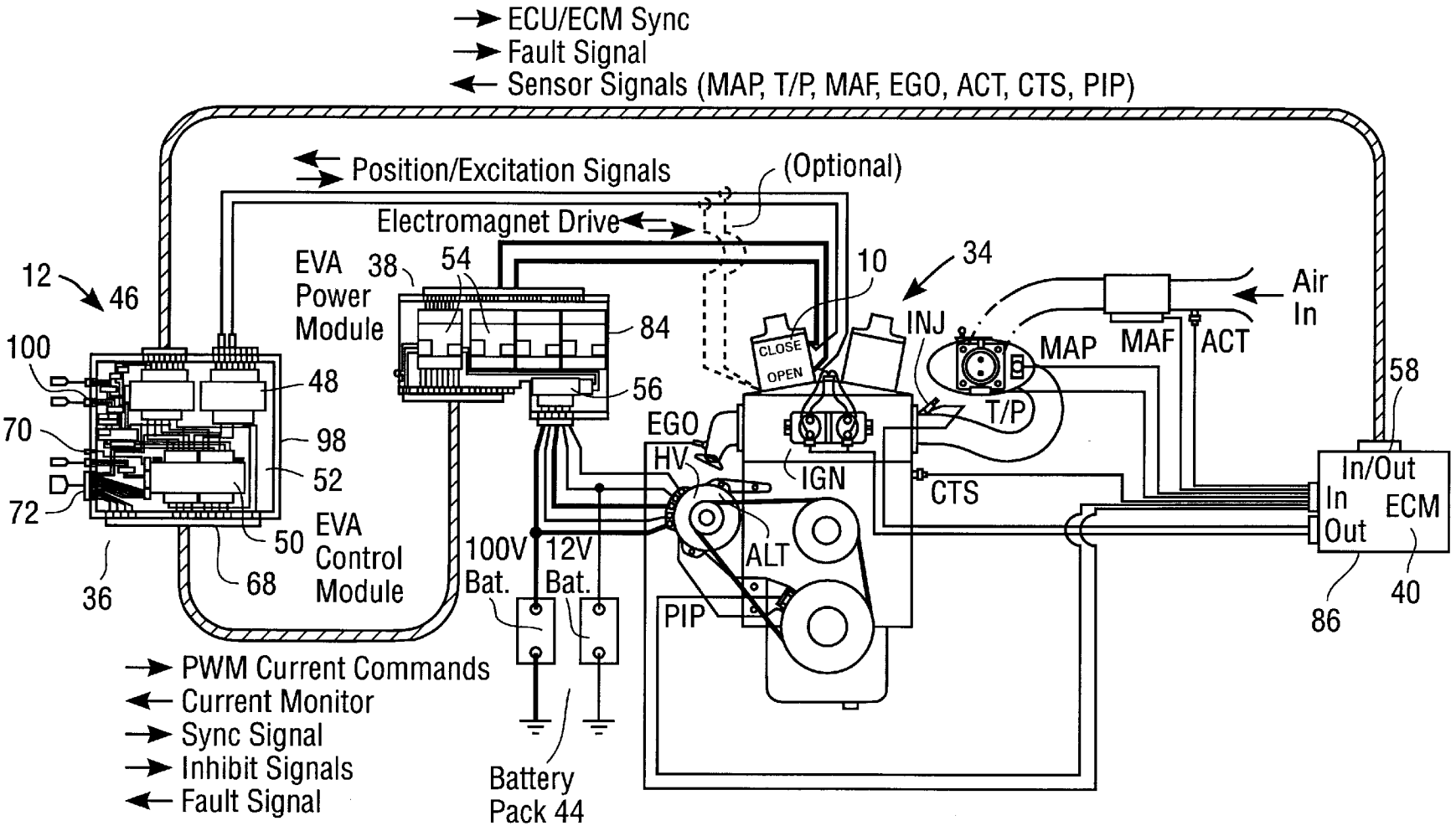
FIG. 2 is a diagram of the servo control system of the present invention.

Referring now to FIG. 2, the arrangement of the servo control system 12 is shown, incorporating the electromagnetic actuator 10 described hereinabove. The servo control system 12 of the present invention includes three major sub-systems; an electromagnetic valve actuator equipped engine 34, an electromagnetic valve actuator control module 36, and an electromagnetic valve actuator power module 38.

Figure 5:
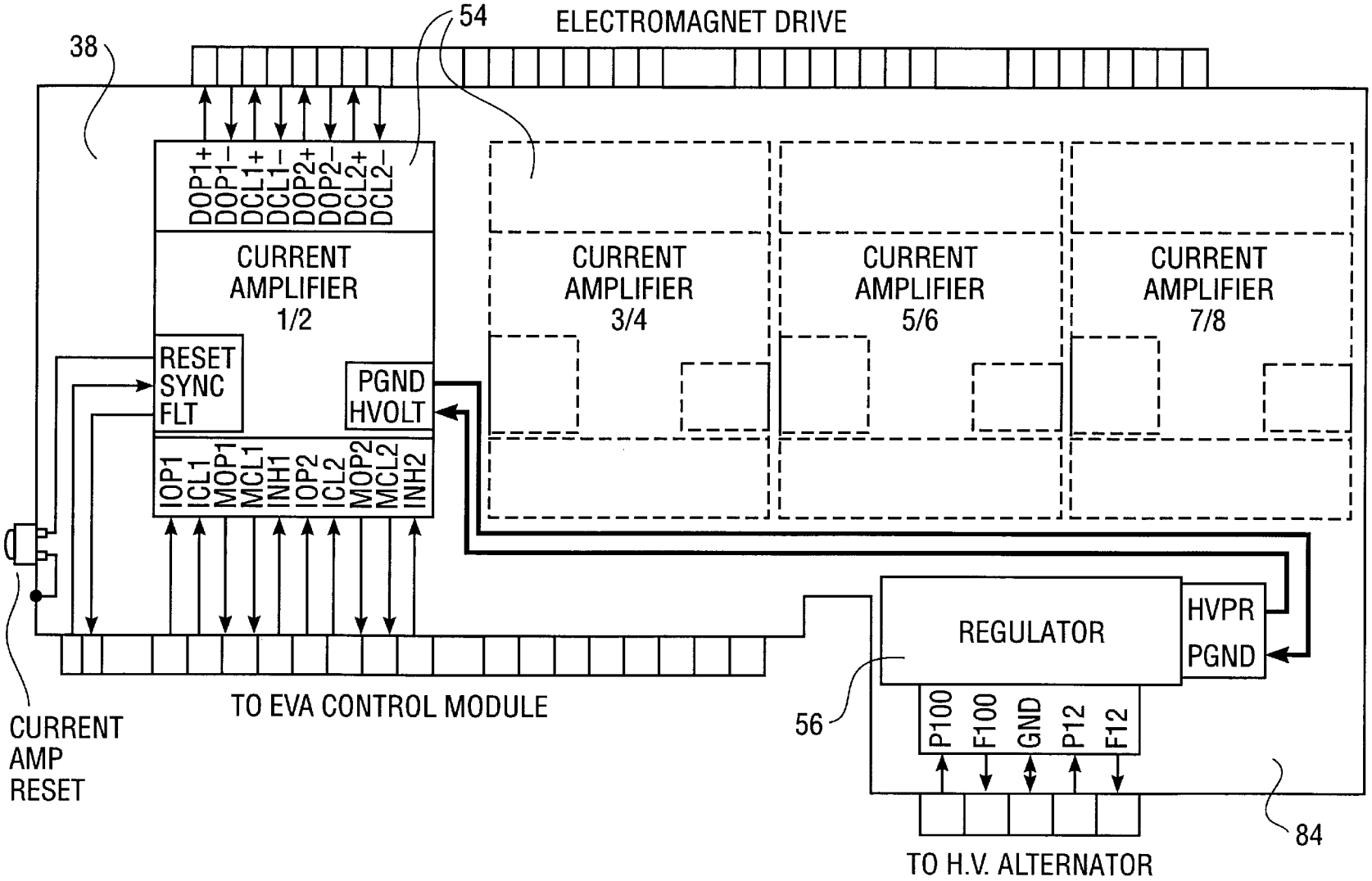
FIG. 5 is a block diagram of the power module of the servo control system of the present invention.

In the preferred embodiment, the electromagnetic valve actuator equipped engine 34 comprises the electromagnetic valve actuator 10, an engine control module (ECM) 40, a high power alternator 42, and a battery pack 44. The electromagnetically actuated valve control module 36 preferably comprises at least one electronic control unit (ECU) 46, at least one demodulation board 48, at least one servo board 50, and a control module mother board 52. As shown in FIG. 5, the electromagnetic valve actuator power module 38 preferably comprises at least one current amplifier 54 and a regulator 56.

As previously described, the first major subsystem, the electromagnetic valve actuator equipped engine 43 comprises the electromagnetic valve actuator 10, the engine control module (ECM) 40, the high power alternator 42, and the battery pack 44. As also previously described, the electromagnetic valve actuators 10 preferably consist of two electromagnets 14,16, the ferrous armature 22, the ferrous guide shaft 24, two springs 18,20 and the position sensor 30. The stock ECM 40 of the engine may include a buffered input/output sensor signal port 58 for connection to the control module 36. The high powered alternator 42 provides approximately 100 VDC power for operation of the power module 38 and the electromagnetic valve actuator 10. The high powered alternator also provides 12 VDC power for operation of the remainder of the vehicle systems (not shown). The alternator 42 may be a dual mode type that outputs both voltage levels at the alternator, or a single mode type that outputs voltage for one rail only. Alternator output is controlled by the regulator 56 located in the power module 38. The battery pack 44 supplies approximately 100 VDC to the power module 38 during engine start. The battery pack 44 also functions as a buffer or load for the high-power alternator 42. The battery pack may also provide supplemental power under peak conditions if required. It is to be noted that a high power generator may be substituted for the high power alternator 42.

Figure 3:
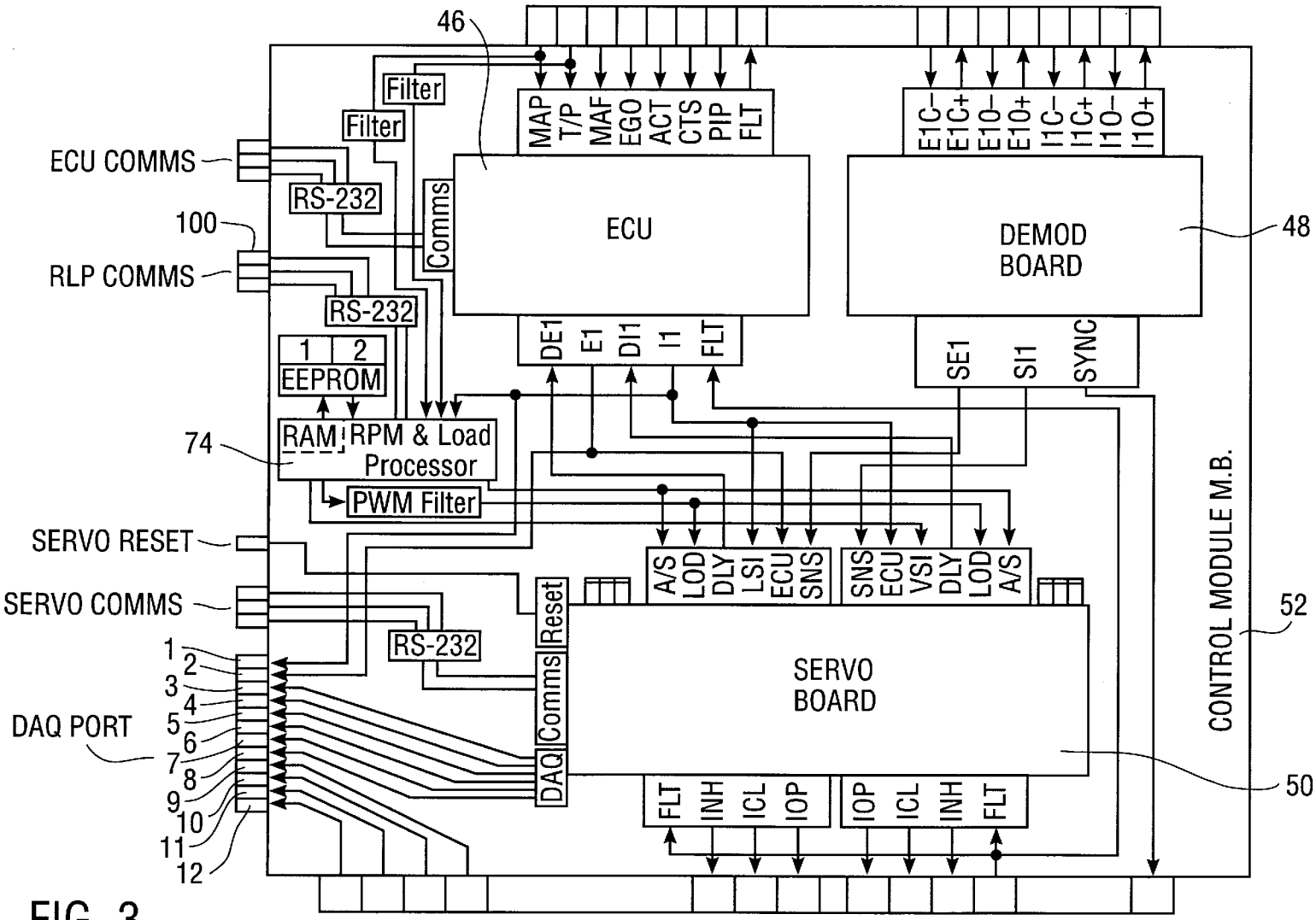
FIG. 3 is a block diagram of the control module of the servo control system of the present invention.
Figure 4:
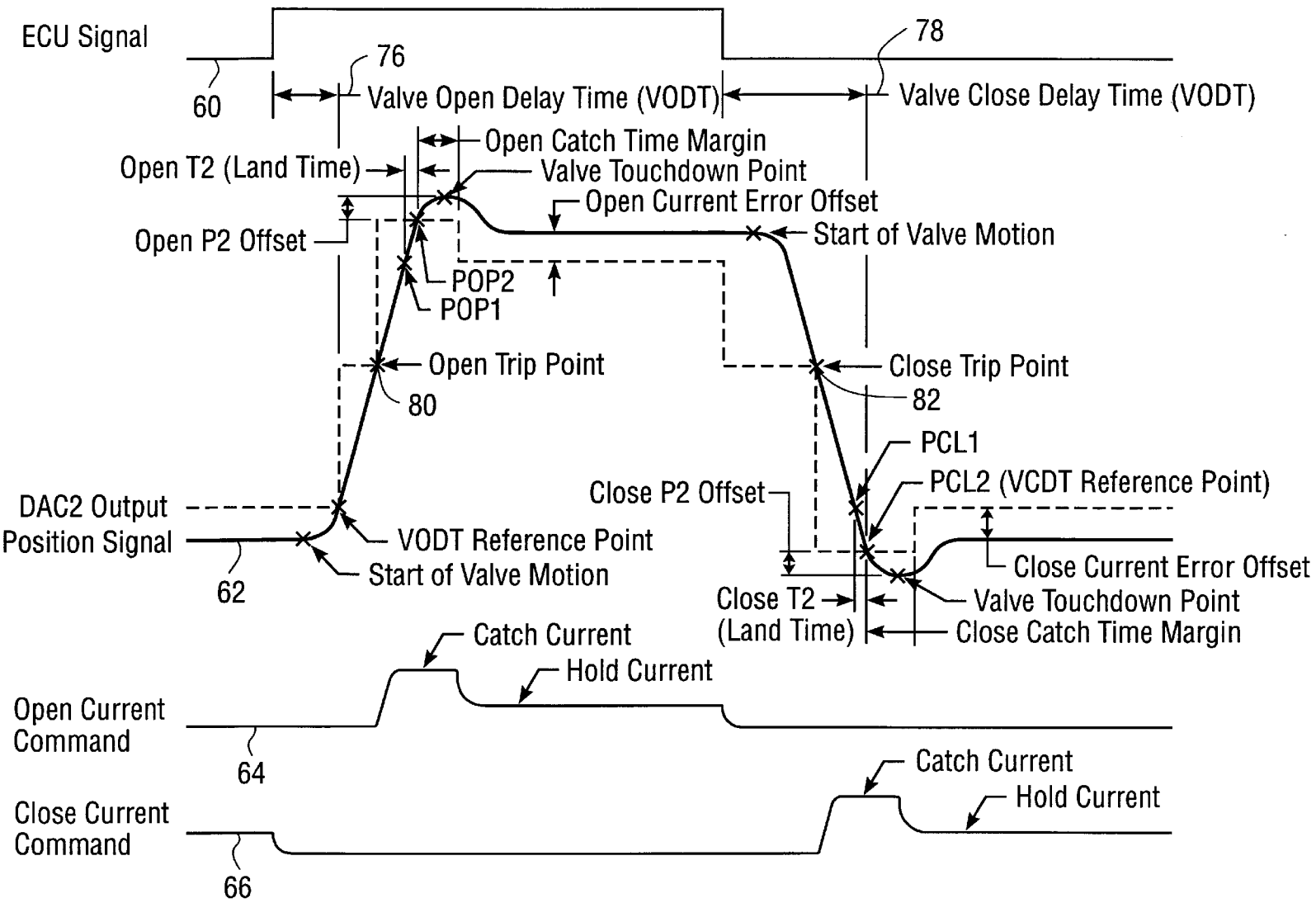
FIG. 4 is a signal diagram for the servo control system of the present invention.

Referring now to FIGS. 2, 3 and 4, the control module 36 of the servo control system is shown. The control module 36 comprises four components: the electronic control unit 46, the demodulation board 48, the servo board 50, and the control module mother board 52. The electronic control unit 46 controls the electromagnetic valve actuator timing. The electronic control unit 46 receives engine sensor information by tapping into the ECM 40 wiring harness, or alternatively by connecting to the ECM's input/output sensor port 58. The electronic control unit 46 determines the proper valve timing based on various parameters including rpm, engine load, and the crankshaft position information pulse signal. The electronic control unit 46 outputs a plurality of high-going and low-going square wave electronic control unit command signals 60 to the servo board 50 corresponding to the valve opening and valve closing sequences, respectively. The valve opening and valve closing sequences are synchronized with the engine's fueling and spark timing by means of the synchronization signal sent from the electronic control unit 46 and engine control module 40. A valve open delay time (VODT) trip or delay feedback signal and a valve close delay time (VCDT) trip or delay feedback signal are fed back to the electronic control unit 46 from the servo board 50 to maintain valve timing accuracy. The electronic control unit 46 is also the source of intake valve blipping commands.

Referring again to FIGS. 2, 3 and 4, the demodulation board 48 is described in detail. The demodulation board 48 is coupled to the servo board 50. In the present invention the demodulation board 48 sends a valve position voltage signal 62 to the servo boards 50. The valve position voltage signal 62 is proportional to the valve or armature position. In order to generate the valve position voltage signal 62, the demodulation board 48 generates a plurality of excitation signals that are sent to the sense coils 32 of the position sensor 30 located within the electromagnetic valve actuator 10. The strength of a returning excitation signal is then demodulated to retrieve valve position information. The demodulation board 48 also provides a triangle-wave synchronization signal to the power module current amplifiers 54 for synchronization purposes.

Referring now to FIG. 2, the servo board 50 is described in detail. The servo board SO controls actuator motion and is coupled to the electronic control unit 46 and the demodulation board 48. The servo board 50 provides a open current command signal 64 and a close current command signal 66 to the current amplifiers 54 that controls how the electrical current is applied to the electromagnets 14,16 of the actuated valve 10. The servo board 50 controls valve initialization, low rpm intake valve shutdown, intake valve blipping, and normal valve opening and closing functions. The servo board 50 also detects a plurality of fault signals from the current amplifiers 54 for over temperature and short circuits and sends back a plurality of corresponding inhibit signals to shut down the current amplifiers 54. The fault signals from the current amplifiers 54 are also sent to the electronic control unit 46 and the ECM 40. The electronic control unit 46 and the ECM 40 generate an inhibit signal to inhibit the valve timing commands, fuel injectors and ignition spark. As previously described, the servo board 50 sends the valve open delay time (VODT) and valve close delay time (VCDT) trip signals back to the electronic control unit 46 to maintain valve timing accuracy. An auxiliary servo program software reset line is wired to a housing 68 of the control module 60 and may be activated by a manual push button 70. The servo software performs an automatic reset on power up. Servo program software settings may be altered using special communications software and the servo comms provided. A data acquisition (DAQ) port 72 providing servo signals used for servo tuning and trouble shooting is also provided.

Referring again to FIGS. 2 and 3, the control module mother board 52 is described in detail. The control module mother board 52 acts as a mounting surface for the electronic control unit 46, the demodulation board 48, and the servo board 50. The mother board 52 also provides power and signal feeds between the electronic control unit 46, demodulation board 48 and servo board so.

Figure 6:
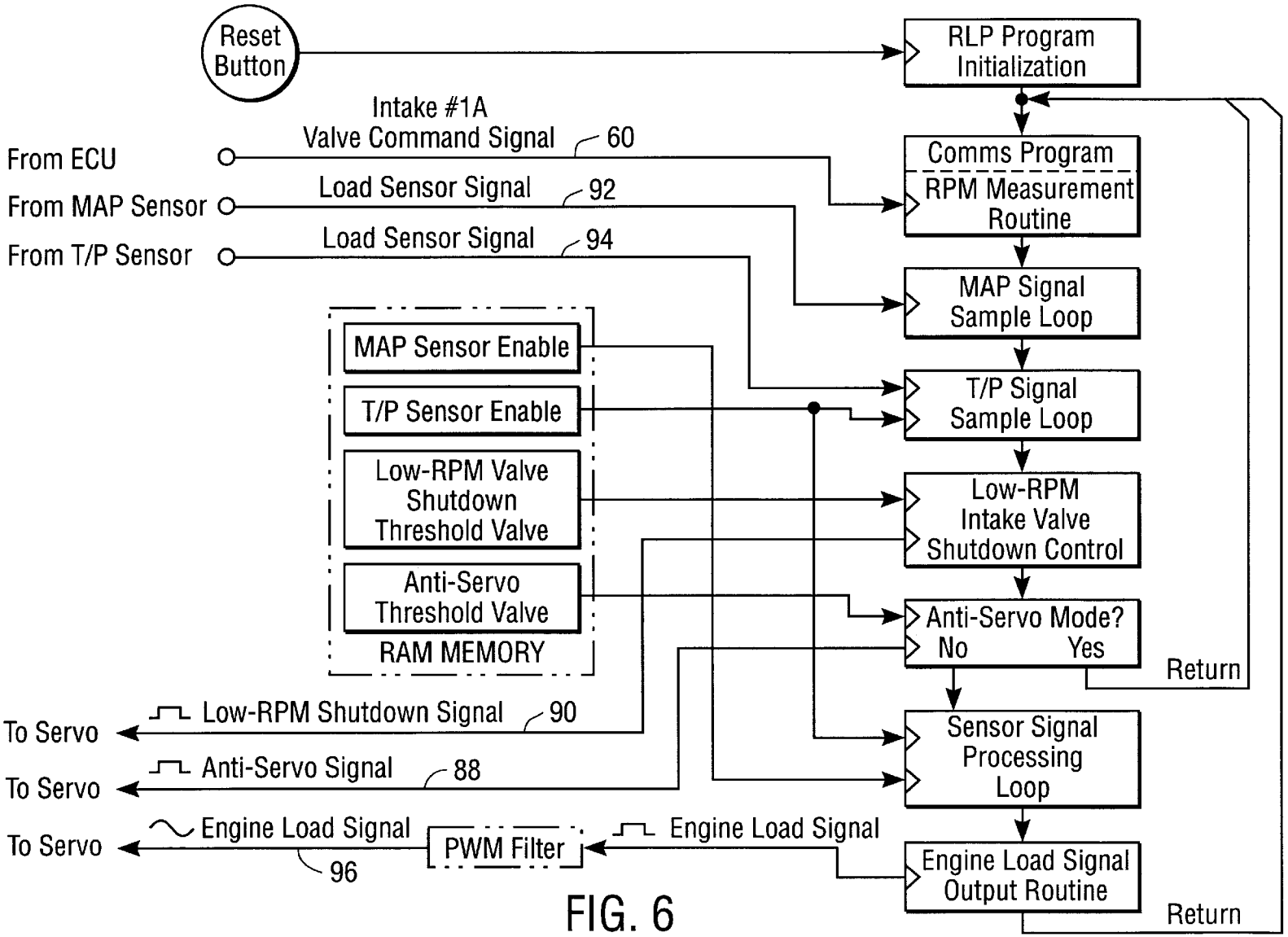
FIG. 6 is a block diagram of the RPM and load processor function.

The mother board 52 also supports a RPM and load processor (RLP) 74, as shown in FIG. 3. Referring now to FIG. 6, the RLP 74 calculates engine rpm and outputs two rpm dependent digital control signals 88,90 to the servo board 50. One of these signals is an anti-servo control signal 88 and the other is a low-rpm shutdown signal 90. During the engine cranking period and during the period when the engine first catches and runs up to idle speed the cylinder pressures are unstable. In order to improve control of the valve transition and prevent valve fall-out caused by unstable pressure loading on the valve the servo board adds maximum electromagnetic energy to the valve transition. When the engine starts and is running smoothly the maximum electromagnetic energy is no longer required. The servo board therefore ceases the maximum electromagnetic energy at the point when the rpm rises above the anti-servo threshold. The use of the anti-servo threshold therefore minimizes power consumption and noise during normal operation at and above idle rpm, yet ensures robust operation during starting.

On engine designs that have at least two intake valves per cylinder, intake flow velocity at low rpm may be increased holding one or more of the intake valves closed, therefore forcing the flow to enter the cylinder by passing through the other operating intake valves. The increased flow velocity helps promote charge mixing. At higher rpm however, lack of flow velocity is no longer an issue and gains in engine volumetric efficiency can be realized by allowing the intake charge to flow through both valves again. The threshold that defines the rpm below which it is desirable to shut down one intake valve is the low-rpm shutdown threshold, and is controlled by the low-rpm shutdown signal 90.

The RLP 74 also samples two engine load sensor signals 92,94 and outputs one processed engine load signal 96 to the servo board. The two engine load sensor signals 92,94 are used by the RLP to measure engine load. One of the signals is a manifold absolute pressure sensor signal 92 and the other signal is a throttle position sensor signal 94. A mass and flow sensor can be substituted for the manifold absolute pressure sensor. The processed engine load signal 96 is used in the servo control system feed forward loop to determine how much adjustment to the trip points 80,82 is required to maintain a successful valve transition under changing engine load conditions. RLP software settings may be altered using special communications software and the RLP comms 100 provided.

Referring again to FIG. 4, the various signals of the present invention are diagrammed. The electronic control unit command signal 60 is first shown. The electronic control unit command signal 60 is fed from the electronic control unit 46 to the servo board 50 to command valve transition. Below the electronic control unit command signal 60 is the valve position signal 62. The valve position signal 62 is generated by the demodulation board 48 and sent to the servo board 50. In the preferred embodiment, the valve position signal 62 is proportional to the position of the retainer 28 or other target area of the electromagnetic valve actuator 10, such as the armature. The open current command signal 64 and the close current command signal 66 are diagrammed below the valve position signal 62. The current command signals 64,66 are low level signals sent from the servo board 50 to the current amplifiers 54. The signal diagram further defines the valve open delay time 76 as the time period between the point where the electronic control unit current command signal 60 sends an open signal and the point where the valve actually starts to move toward the open position. The valve close delay time 78 is defined as the time period between the point where the electronic control unit current command signal 60 sends a close signal and the point where the valve almost reaches the closed position. The open trip point 80, the close trip point 82 and other parameters of the valve motion and position are also diagrammed.

Referring again to FIGS. 2 and 5, the power module 38 of the servo control system is shown. It is to be noted that the power module 38 is contained within a power module housing 84 that is separate from both a housing 86 for the engine control module and a housing 98 for the control module 68. This arrangement is desirable because the power module 38 operates at high voltage and currents, whereas the engine control module operates at low voltage and currents. This physical separation helps reduce transfer of noise between the power module, the engine control module and the control module. The power module 38 comprises the current amplifiers 54 and the regulator 56. The current amplifiers 54 convert the low level current electronic control unit command signal 60 from the servo board 50 into a current mode output (PWM'd 100 VDC rail) that drives the current through the actuator electromagnets. Each current amplifier 54 can power two valves. The current amplifiers 54 are synchronized by a triangle wave synchronization signal sent from the demodulation board 48. For data acquisition purposes the current amplifiers 54 output to the control module 36 a current monitor voltage signal proportional to actual current output. Over-temperature and short circuit detection safety features are incorporated in the current amplifiers 54. If either occurs, the fault signals are sent to the servo board 50, the electronic control unit 46 and the engine control module 40 that respond by inhibiting the current amplifiers 54, inhibiting the valve timing commands, and shutting off fuel and ignition spark to that cylinder or the entire engine. The fault signal caused by an over temperature condition is self-canceling. Once the temperature drops below a preset level engine operation may resume. The fault signal caused by a short circuit condition, however, is latched and can only be cleared by correcting the fault and pushing the manual reset button.

Regulator 56 circuitry for the high power alternator 42 is housed within the power module 38. The regulator 56 is coupled to the current amplifiers 54. The regulator 56 feeds the alternator's 42 rotor windings an excitation voltage so as to maintain the desired approximate 100 VDC rail output to the current amplifiers 54 and battery pack 44.

There has been described hereinabove an exemplary preferred embodiment of the servo control system for an electromagnetic valve actuator according to the principles of the present invention. Those skilled in the art may now make numerous uses of, and departures from, the above-described embodiments without departing from the inventive concepts disclosed herein. Accordingly, the present invention is to be defined solely by the scope of the following claims.

What is claimed is:

1. A servo control system for an internal combustion engine having an engine control module, an alternator and at least one cylinder, each cylinder having at least one valve and an electromagnetic valve actuator comprising;

an electromagnetic valve actuator control module, said electromagnetic valve actuator control module further comprising an electronic control unit coupled to the engine control module for receiving engine sensor information, a servo board coupled to said electronic control unit for receiving a command signal and sending a plurality of delay feedback signals to said electronic control unit, and a demodulation board coupled to said servo board for sending a voltage signal proportional to the valve position to said servo board; and a power module coupled to said electromagnetic valve actuator and said electromagnetic valve actuator control module, said power module providing a current output to said electromagnetic valve actuator and providing a current monitor signal proportional to said current output to said electromagnetic valve actuator control module.

2. A servo control system in accordance with claim 1 wherein said control module further comprises a mother board, said mother board coupled to each of said electronic control unit, said demodulation board and said servo board and providing power and signal feed between said electronic control unit, said demodulation board and said servo board.

3. A servo control system in accordance with claim 1 wherein said power module further comprises at least one current amplifier.

4. A servo control system in accordance with claim 3 wherein said current amplifier is coupled to said demodulation board for receiving a triangular wave synchronization signal from said demodulation board.

5. A servo control system in accordance with claim 1 wherein said current amplifier is coupled to said servo board, said electronic control unit and the engine control module and further wherein said servo board detects a plurality of fault signals from said current amplifier for over temperature and short circuits and in response sends a corresponding inhibit signal to said current amplifier.

6. A servo control system in accordance with claim 3 wherein said power module further comprises a regulator coupled to said current amplifier and the alternator.

7. A servo control system in accordance with claim 1 further comprising a valve position sensor coupled to said control module, said position sensor detecting the position of the valve and providing a corresponding position signal to said electromagnetic valve actuator control module.

8. A servo control system in accordance with claim 7 wherein said demodulation board is coupled to said position sensor for sending an excitation signal to said position sensor and receiving said position signal in response from said position sensor.

9. A servo control system in accordance with claim 2 further comprising a RPM and load processor mounted on said mother board.

10. A method for controlling an electromagnetic valve actuator used to control a valve within an internal combustion engine having an engine control module comprising the steps of:

sensing engine information from the engine control module;

sensing the position of the valve;

generating voltage signals proportional to the sensed valve position;

generating a command signal corresponding to the sensed engine information;

generating a current command signal in response to said valve position voltage signal and said command signal;

utilizing at least one current amplifier to drive a current output corresponding to the current command signal through the valve electromagnets; and sending the current monitor voltage signal proportional to the current output back to the electromagnetic valve actuator control module for data acquisition use.

11. A method for controlling an electromagnetic valve actuator in accordance with claim 10 further comprising the steps of:

generating fault signals in response to over-temperature and short circuit;

sending the fault signals from the current amplifier to the servo board; and sending inhibit signals from the servo board to the current amplifier in response to the fault signals.

12. A method for controlling an electromagnetic valve actuator in accordance with claim 10 further comprising the steps of:

generating a synchronization signal; and utilizing said synchronization signal for current amplifier synchronization.

13. A method for controlling an electromagnetic valve actuator in accordance with claim 10 further comprising the steps of:

generating delay feedback signals in response to the delayed opening and closing of the valve; and utilizing said delay feedback signals to maintain valve timing accuracy.

14. A servo control system for an internal combustion engine having an engine control module and at least one cylinder, each cylinder having at least one valve with an electromagnetic valve actuator comprising:

means for sensing engine information from the engine control module;

means for sensing the position of the valve;

means for generating voltage signals proportional to the sensed valve position;

means for generating a command signal corresponding to the sensed engine information;

means for generating a current command signal in response to said valve position voltage signal and said command signal;

means for driving a current output corresponding to the current command signal through the valve electromagnets; and means for feeding a current monitor voltage signal proportional to the current output back to the current command generating means for use in generating said current command signal.

15. A servo control system in accordance with claim 14 further comprising:

means for generating fault signals from the current output driving means in response to over-temperature and short circuit; and means for inhibiting the current output means, valve timing commands, fuel supply and ignition spark in response to the fault signals.

16. A servo control system in accordance with claim 14 further comprising:

means for generating delay feedback signals in response to the delayed opening and closing of the valve; and means for utilizing said delay feedback signals to maintain valve timing accuracy.

* * * * *